US008899971B2

(12) United States Patent
Mateos Martin et al.

(10) Patent No.: US 8,899,971 B2
(45) Date of Patent: Dec. 2, 2014

(54) DUAL FUEL GAS HEATER

(75) Inventors: Ruben Mateos Martin, Marietta, GA (US); José Joaquin Antxia Uribetxebarria, Aretxabaleta (ES)

(73) Assignee: Coprecitec, S.L., Aretxabaleta (Gipuzkoa) (ES)

( * ) Notice: Subject to any disclaimer, the term of this patent is extended or adjusted under 35 U.S.C. 154(b) by 1116 days.

(21) Appl. No.: 12/860,755

(22) Filed: Aug. 20, 2010

(65) Prior Publication Data

US 2012/0045726 A1 Feb. 23, 2012

(51) Int. Cl.

| | |
|---|---|
| ***F23N 1/02*** | (2006.01) |
| ***F23N 1/00*** | (2006.01) |
| ***F23D 23/00*** | (2006.01) |
| ***F23N 5/02*** | (2006.01) |

(52) U.S. Cl.

CPC ..... *F23D 23/00* (2013.01); *F23N 2025/16* (2013.01); *F23D 2900/21004* (2013.01); *F23N 2021/10* (2013.01); *F23N 1/005* (2013.01); *F23N 1/002* (2013.01); *F23N 2037/08* (2013.01); *F23D 2900/00014* (2013.01); *F23N 5/022* (2013.01); *F23D 2208/00* (2013.01)

USPC ..... 431/89; 431/281; 431/285

(58) Field of Classification Search

CPC ..... F23N 1/005; F23N 1/025

USPC ..... 431/89, 281, 285

See application file for complete search history.

(56) References Cited

U.S. PATENT DOCUMENTS

| | | | |
|---|---|---|---|
| 962,752 | A | 6/1910 | Dudgeon |
| 1,639,780 | A | 8/1927 | Mulholland |
| 2,129,231 | A | 9/1938 | Parker |
| 2,380,956 | A | 8/1945 | Evarts |

(Continued)

FOREIGN PATENT DOCUMENTS

| | | |
|---|---|---|
| DE | 720854 | 5/1942 |
| ES | U200800992 | 7/2008 |

(Continued)

OTHER PUBLICATIONS

Style Selections; Vent-Fee Fireplace; Model 55ID280T; US; available as of Mar. 9, 2007.

(Continued)

*Primary Examiner* — Kenneth Rinehart
*Assistant Examiner* — Gajanan M Prabhu
(74) *Attorney, Agent, or Firm* — Tim L. Kitchen; Peter B. Scull; Hamilton DeSanctis & Cha LLP

(57) ABSTRACT

A dual fuel vent free gas heater. In one implementation the heater includes a gas burner adapted to receive one of a first type of gas or of a second type of gas with a first pilot burner intended to receive the first type of gas and a second pilot burner intended to receive the second type of gas. A first temperature sensor is located adjacent the first pilot burner and a second temperature sensor is located adjacent the second pilot burner. A normally closed thermal switch is coupled to the first temperature sensor and located in the electrical flow path between a voltage source and a gas control valve actuator, the thermal switch configured to open when the temperature detected by the first temperature sensor exceeds a predetermined temperature indicative that the second type of gas is being delivered to the first pilot burner.

14 Claims, 11 Drawing Sheets

(56) References Cited

U.S. PATENT DOCUMENTS

| | | | |
|---|---|---|---|
| 2,582,582 | A | 1/1952 | Bottom |
| 2,592,132 | A | 4/1952 | Archie et al. |
| 2,630,821 | A | 3/1953 | Arey et al. |
| 2,661,157 | A | 12/1953 | Reichelderfer |
| 2,687,140 | A | 8/1954 | St. Clair |
| 2,750,997 | A | 6/1956 | Reuter |
| 3,001,541 | A | 9/1961 | Clair |
| 3,082,305 | A | 3/1963 | Wunder |
| 3,139,879 | A | 7/1964 | Bauer et al. |
| 3,265,299 | A | 8/1966 | Rice et al. |
| 3,295,585 | A | 1/1967 | Kovack, Jr. et al. |
| 3,331,392 | A | 7/1967 | Davidson et al. |
| 3,469,590 | A | 9/1969 | Barker |
| 3,590,806 | A | 7/1971 | Locke |
| 3,595,270 | A | 7/1971 | McNeal, Jr. |
| 3,706,303 | A | 12/1972 | Hapgood |
| 3,747,586 | A | 7/1973 | Weiss |
| 3,814,573 | A | 6/1974 | Karlovetz |
| 3,817,686 | A | 6/1974 | Quittner |
| D243,694 | S | 3/1977 | Faulkner |
| 4,020,870 | A | 5/1977 | Carlson |
| 4,290,450 | A | 9/1981 | Swanson |
| 4,340,362 | A | 7/1982 | Chalupsky et al. |
| 4,348,172 | A | 9/1982 | Miller |
| 4,355,659 | A | 10/1982 | Kelchner |
| 4,640,674 | A | 2/1987 | Kitchen |
| 4,640,680 | A | 2/1987 | Schilling |
| 4,651,711 | A | 3/1987 | Velie |
| 4,718,448 | A | 1/1988 | Love et al. |
| 4,718,846 | A | 1/1988 | Oguri et al. |
| 4,768,543 | A | 9/1988 | Wienke et al. |
| 4,768,947 | A | 9/1988 | Adachi |
| 4,779,643 | A | 10/1988 | Genbauffe |
| 4,782,814 | A | 11/1988 | Cherryholmes |
| 4,848,313 | A | 7/1989 | Velie |
| 4,930,538 | A | 6/1990 | Browne |
| 4,962,749 | A | 10/1990 | Dempsey et al. |
| 4,965,707 | A | 10/1990 | Butterfield |
| 5,039,007 | A | 8/1991 | Wolter |
| 5,090,899 | A | 2/1992 | Kee |
| 5,172,728 | A | 12/1992 | Tsukazaki |
| 5,199,385 | A | 4/1993 | Doss |
| 5,201,651 | A | 4/1993 | Niksic et al. |
| 5,239,979 | A | 8/1993 | Maurice et al. |
| 5,251,823 | A | 10/1993 | Joshi et al. |
| 5,314,007 | A | 5/1994 | Christenson |
| 5,393,222 | A | 2/1995 | Sutton |
| 5,413,141 | A | 5/1995 | Dietiker |
| 5,452,709 | A | 9/1995 | Mealer |
| 5,470,018 | A | 11/1995 | Smith |
| 5,503,550 | A | 4/1996 | DePalma |
| 5,513,798 | A | 5/1996 | Tavor |
| 5,542,609 | A | 8/1996 | Meyers |
| 5,553,603 | A | 9/1996 | Barudi et al. |
| 5,567,141 | A | 10/1996 | Josh et al. |
| 5,575,274 | A | 11/1996 | DePalma |
| 5,584,680 | A | 12/1996 | Kim |
| 5,603,211 | A | 2/1997 | Graves |
| 5,642,580 | A | 7/1997 | Hess et al. |
| 5,645,043 | A | 7/1997 | Long et al. |
| D391,345 | S | 2/1998 | Mandir et al. |
| 5,738,084 | A | 4/1998 | Hussong |
| 5,782,626 | A | 7/1998 | Joos et al. |
| 5,807,098 | A | 9/1998 | Deng |
| 5,814,121 | A | 9/1998 | Travis |
| 5,838,243 | A | 11/1998 | Gallo |
| 5,839,428 | A | 11/1998 | Schroeter et al. |
| 5,906,197 | A | 5/1999 | French et al. |
| 5,915,952 | A | 6/1999 | Manning et al. |
| 5,941,699 | A | 8/1999 | Abele |
| 5,966,937 | A | 10/1999 | Graves |
| 5,975,112 | A | 11/1999 | Ohmi et al. |
| 5,984,662 | A | 11/1999 | Barudi et al. |
| 5,987,889 | A | 11/1999 | Graves et al. |
| 5,988,204 | A | 11/1999 | Reinhardt et al. |
| 6,035,893 | A | 3/2000 | Ohmi et al. |
| 6,045,058 | A | 4/2000 | Dobbeling et al. |
| 6,068,017 | A | 5/2000 | Haworth et al. |
| 6,076,517 | A | 6/2000 | Kahlke et al. |
| 6,170,507 | B1 | 1/2001 | Dalton et al. |
| 6,197,195 | B1 | 3/2001 | Booth et al. |
| 6,227,194 | B1 | 5/2001 | Barudi et al. |
| 6,227,451 | B1 | 5/2001 | Caruso |
| 6,244,524 | B1 | 6/2001 | Tackels et al. |
| 6,257,230 | B1 | 7/2001 | Barudi et al. |
| 6,257,270 | B1 | 7/2001 | Ohmi et al. |
| 6,257,871 | B1 | 7/2001 | Weiss et al. |
| 6,321,779 | B1 | 11/2001 | Miller et al. |
| 6,340,298 | B1 | 1/2002 | Vandrak et al. |
| 6,354,072 | B1 | 3/2002 | Hura |
| 6,443,130 | B1 | 9/2002 | Turner et al. |
| 6,543,235 | B1 | 4/2003 | Crocker et al. |
| 6,648,635 | B2 | 11/2003 | Vandrak et al. |
| 6,705,342 | B2 | 3/2004 | Santinanavat et al. |
| 6,880,549 | B2 | 4/2005 | Topp |
| 6,884,065 | B2 | 4/2005 | Vandrak et al. |
| 6,904,873 | B1 | 6/2005 | Ashton |
| 6,938,634 | B2 | 9/2005 | Dewey, Jr. |
| 7,044,729 | B2 | 5/2006 | Ayastuy et al. |
| 7,251,940 | B2 | 8/2007 | Graves et al. |
| 7,300,278 | B2 | 11/2007 | Vandrak et al. |
| 7,434,447 | B2 | 10/2008 | Deng |
| 7,497,386 | B2 * | 3/2009 | Donnelly et al. ..... 236/15 BG |
| 7,607,426 | B2 | 10/2009 | Deng |
| 7,730,765 | B2 | 6/2010 | Deng |
| 7,766,006 | B1 * | 8/2010 | Manning ..... 126/99 R |
| 2001/0037829 | A1 | 11/2001 | Shaw et al. |
| 2002/0058266 | A1 | 5/2002 | Clough et al. |
| 2002/0160325 | A1 | 10/2002 | Deng |
| 2002/0160326 | A1 | 10/2002 | Deng |
| 2003/0168102 | A1 | 9/2003 | Santinanavat et al. |
| 2003/0192591 | A1 | 10/2003 | Strom |
| 2003/0198908 | A1 | 10/2003 | Berthold et al. |
| 2004/0096790 | A1 | 5/2004 | Querejeta et al. |
| 2004/0238029 | A1 | 12/2004 | Haddad |
| 2004/0238030 | A1 | 12/2004 | Dewey, Jr. |
| 2005/0175944 | A1 | 8/2005 | Ahamady |
| 2007/0224558 | A1 | 9/2007 | Flick et al. |
| 2007/0266765 | A1 | 11/2007 | Deng |
| 2007/0277803 | A1 | 12/2007 | Deng |
| 2007/0277812 | A1 | 12/2007 | Deng |
| 2007/0277813 | A1 | 12/2007 | Deng |
| 2008/0149871 | A1 | 6/2008 | Deng |
| 2008/0149872 | A1 | 6/2008 | Deng |
| 2008/0153044 | A1 | 6/2008 | Deng |
| 2008/0153045 | A1 | 6/2008 | Deng |
| 2008/0223465 | A1 | 9/2008 | Deng |
| 2008/0227045 | A1 * | 9/2008 | Deng ..... 431/354 |
| 2009/0280448 | A1 | 11/2009 | Antxia Uribetxebarria et al. |

FOREIGN PATENT DOCUMENTS

| | | | |
|---|---|---|---|
| GB | 2319106 | A | 5/1998 |
| GB | 2330438 | A | 4/1999 |
| JP | 58219320 | | 12/1983 |
| JP | 03230015 | | 10/1991 |
| JP | 2003056845 | | 2/2003 |
| JP | 2003074837 | | 3/2003 |
| JP | 2003074838 | | 3/2003 |
| WO | WO0050815 | A1 | 8/2000 |

OTHER PUBLICATIONS

Comfort Glow; Vent-Free Gas Space Heaters; Ultra Slim; available as of Mar. 9, 2007.

Comfort Glow; Vent-Free Gas Space Heaters; Solarfusion; available as of Mar. 9, 2007.

Glo-Warm; Blue Flame Vent-Free Gas Space Heaters; available as of Mar. 9, 2007.

Reddyheater; Garage Heaters; The Outdoorsman; available as of Mar. 9, 2007.

Vanguard; Single Burner 26" Compact; Dual Burner 26" Compact; Classic Hearth 32"; Classic Pro 36"; available as of Mar. 9, 2007.

(56) References Cited

OTHER PUBLICATIONS

Vent-Free Gas Log Heaters; Blaze N Glow Oak; available as of Mar. 9, 2007.
Vanguard; Cast Iron Gas Stove Heaters; available as of Mar. 9, 2007.
Vanguard; Vent-Free Gas Space Heaters; available as of Mar. 9, 2007.
Hearth Sense; Dual Fuel; available as of Mar. 9, 2007.
Napoleon; The Madison Installation and Operation Instructions; May 24, 2005.
Napoleon; Park Avenue Installation and Operation Instructions; Jul. 20, 2006.
Heat and Glo; Escape Series Gas Fireplaces; Mar. 2005.
Heat and Glo; Owners Manual; Escape-42DV; Dec. 2006.

* cited by examiner

DUAL FUEL GAS HEATER

CROSS-REFERENCE TO RELATED APPLICATIONS

This application is related to U.S. Pat. No. 7,766,006 and U.S. application Ser. Nos. 12/643,880, 12/237,131 and 12/237,136.

FIELD OF THE INVENTION

The present invention relates generally to gas heaters and, more particularly, to unvented gas heaters.

BACKGROUND

Unvented gas heaters are designed to be used indoors without pipes, ducts, or other conduit to vent the heater's exhaust to the exterior atmosphere. Vent free gas heaters typically include one or more gas burners and optionally one or more ceramic containing heating elements in a housing. The gas and air mix in the heater where combustion takes place. These heaters may have a blower to force air flow through the heater providing the release of heated gases or convective heat.

Unvented gas heaters have been designed to be free standing, mounted on a wall, or in a decorative housing such as a vent free fireplace. The housing providing a vent free fireplace is typically substantially the size of a fireplace and has artificial logs above the burners. Some have even been designed with a glass front to provide the appearance of an enclosed fireplace.

The unvented heaters of the prior art are typically designed to use either natural gas or liquid propane gas as a fuel source. It is not permitted for a manufacturer to supply a conversion kit for an unvented gas heater to convert from one fuel source to another. Even if such a conversion kit were permitted, as is the case with vented gas heaters, to change fuel source gas type on a heater in the field, requires the installer to change the regulator, pilot orifice and burner orifice for the alternate gas type.

SUMMARY OF THE DISCLOSURE

A dual fuel gas burner is provided for use in a vent free heater. Embodiments of the dual fuel vent free gas burner can be used in free standing heaters, wall mount heaters, gas fireplaces, or other vent free heaters as is known in the art. A dual fuel vent free gas heater provides convective and/or radiant heat preferably to an indoor environment. The heater may be designed to use natural convective air currents and may optionally have a fan enhancing the natural convective currents within the heater. Alternatively, a fan may be used to force the gases and/or air within the heater at desired flow patterns which may be counter to natural convective forces.

This gas heater can be operated with multiple fuels such as liquid propane or natural gas. In some embodiments, an installer turns a selector valve plumbed in the product gas train. This selection sends the correct gas type to the correct fuel injector and pilot burner. Preferably, all plumbing connections are performed at the factory rather than onsite by the user or installer.

Embodiments of the gas heater can be operated on liquid propane or natural gas by connecting the fuel supply to the correct regulator on the heater. The installer or user then turns a selector valve, in selected embodiments, plumbed in the product gas train. This selection sends the correct gas type to the correct injector and pilot burner for the supply gas.

Optionally, an oxygen detection system is incorporated within the heater. Advantageously, the heater is thermostatically controlled.

In one implementation a dual fuel vent free gas heater is provided comprising: a gas burner adapted to receive one of a first type of gas or of a second type of gas, a first pilot burner located adjacent the gas burner and intended to receive the first type of gas, a second pilot burner located adjacent the gas burner intended to receive the second type of gas, a normally closed control valve comprising an actuator and adapted to open upon a predetermined electrical voltage being applied to the actuator, the control valve situated to permit either the first type of gas or the second type of gas to flow through the control valve toward the gas burner when the control valve is in the open position, a first temperature sensor located adjacent the first pilot burner, a second temperature sensor located adjacent the second pilot burner, and a normally closed thermal switch coupled to the first temperature sensor and not couple to the second temperature sensor, the thermal switch located in the electrical flow path between a voltage source and the control valve actuator, the thermal switch configured to open when the temperature detected by the first temperature sensor exceeds a predetermined temperature indicative that the second type of gas is being delivered to the first pilot burner.

In another implementation a dual fuel vent free gas heater is provided comprising: a gas burner adapted to receive one of a first type of gas or of a second type of gas, a first pilot burner located adjacent the gas burner and intended to receive the first type of gas, a second pilot burner located adjacent the gas burner and intended to receive the second type of gas, a first temperature sensor located adjacent the first pilot burner and adapted to generate an electrical voltage deliverable to the control valve upon being heated by a pilot flame emitted by the first pilot burner, a second temperature sensor located adjacent the second pilot burner and adapted to generate an electrical voltage deliverable to the control valve upon being heated by a pilot flame emitted by the second pilot burner, a normally closed control valve comprising an actuator and adapted to open upon a predetermined electrical voltage being applied to the actuator, the control valve situated to permit the first type of gas or the second type of gas to flow through the control valve toward the gas burner when the control valve is in the open position, and a normally closed thermal switch situated between the first temperature sensor and the control valve actuator and not situated between the second temperature sensor and the control valve actuator, the thermal switch configured to open when the temperature detected by the first temperature sensor is indicative that second type of gas is being delivered to the first pilot burner.

In another implementation a dual fuel vent free gas heater is provided comprising: a gas burner adapted to receive one of a liquid propane gas or a natural gas, a first pilot burner located adjacent the gas burner and intended to receive the natural gas, a second pilot burner located adjacent the gas burner and intended to receive the liquid propane gas, a normally closed control valve comprising an actuator and adapted to open upon a predetermined electrical voltage being applied to the actuator, the control valve situated to permit either the natural gas or the liquid propane gas to pass through the control valve towards the gas burner, a first temperature sensor located adjacent the first pilot burner, a second temperature sensor located adjacent the second pilot burner, and a normally closed thermal switch coupled to the first temperature sensor and not coupled to the second temperature sensor, the thermal switch located in the electrical flow path between a voltage source and the control valve actuator, the thermal switch configured to open when the temperature detected by the first temperature sensor is indicative that liquid propane gas is being delivered to the first pilot burner.

In another implementation a dual fuel vent free gas heater is provided comprising: a gas burner adapted to receive one of a liquid propane gas or a natural gas, a first pilot burner located adjacent the gas burner and intended to receive the natural gas, a second pilot burner located adjacent the gas burner and intended to receive the liquid propane gas, a first temperature sensor located adjacent the first pilot burner and adapted to generate an electrical voltage deliverable to the control valve upon being heated by a pilot flame emitted by the first pilot burner; a second temperature sensor located adjacent the second pilot burner and adapted to generate an electrical voltage deliverable to the control valve upon being heated by a pilot flame emitted by the second pilot burner; a normally closed control valve comprising an actuator and adapted to open upon a predetermined electrical voltage being applied to the actuator, the control valve situated to permit the natural gas or the liquid propane gas to flow through the control valve toward the gas burner when the control valve is in the open position, and a normally closed thermal switch situated between the first temperature sensor and the control valve actuator and not the second temperature sensor and the control valve actuator, the thermal switch configured to open when the temperature detected by the first temperature sensor is indicative that liquid propane gas is being delivered to the first pilot burner.

In one implementation the first and second temperature sensors comprise thermocouples.

DETAILED DESCRIPTION

The following description describes embodiments of a dual fuel vent free heater. In the following description, numerous specific details and options are set forth in order to provide a more thorough understanding of the present invention. It will be appreciated, however, by one skilled in the art that the invention may be practiced without such specific details or optional components and that such descriptions are merely for convenience and that such are selected solely for the purpose of illustrating the invention. As such, reference to the figures showing embodiments of the present invention is made to describe the invention and not to limit the scope of the disclosure and claims herein.

Figure 1:
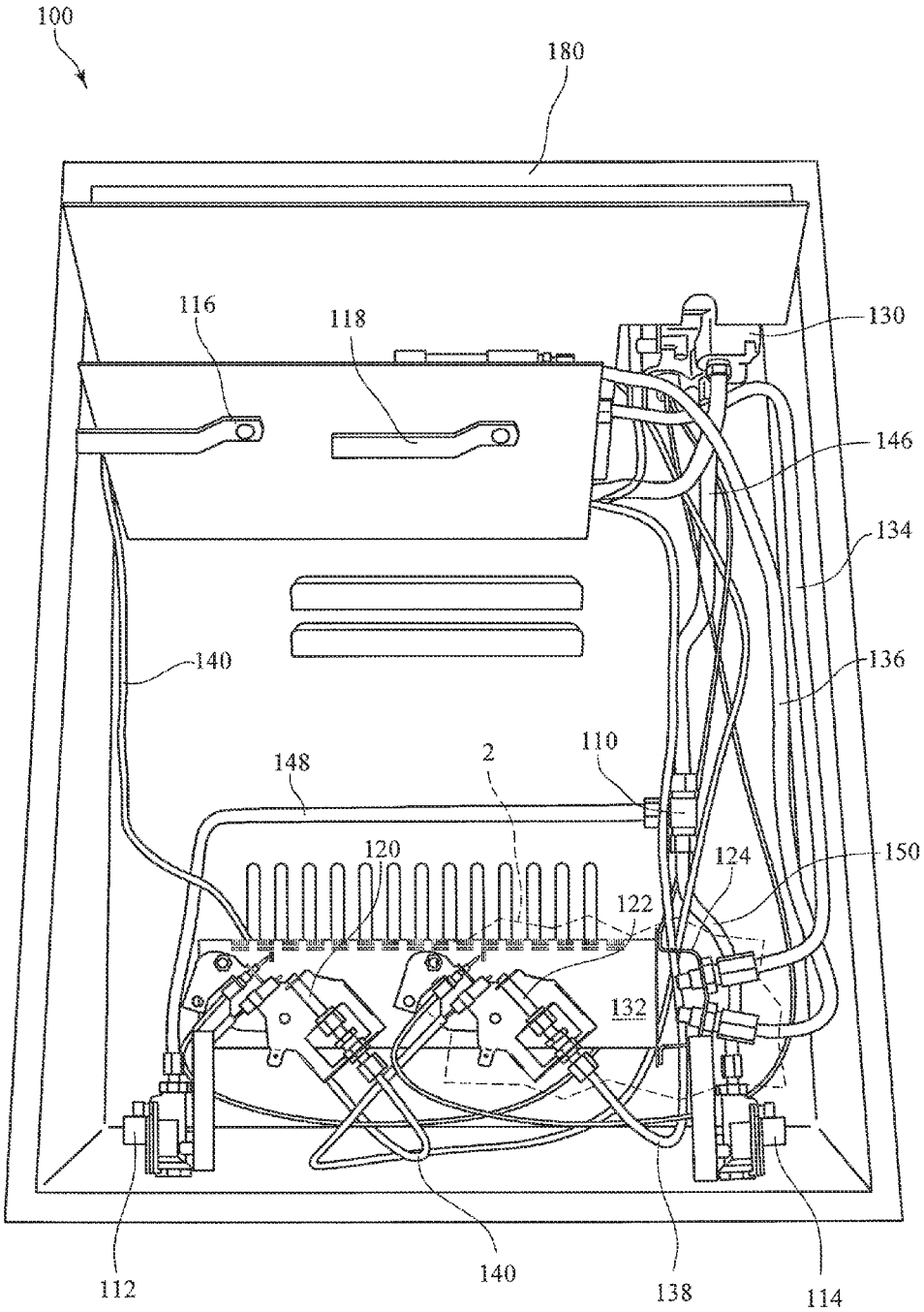
FIG. 1 is a front perspective view of an embodiment of a dual fuel vent free showing heater components thereof assembled within a housing.
Figure 2:
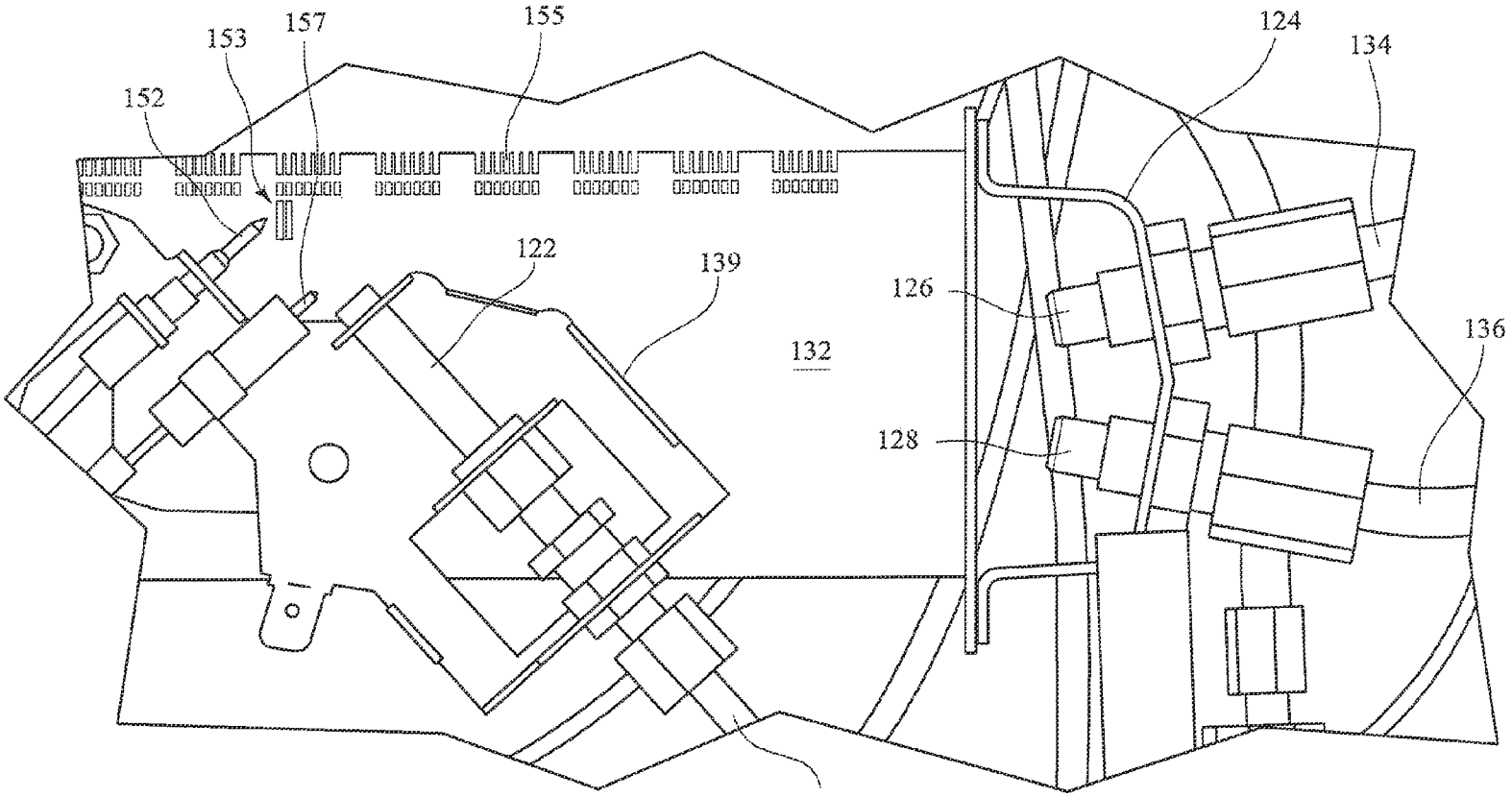
FIG. 2 is a cut-away view of the dual fuel vent free heater of FIG. 1 showing an oxygen detection system.
Figure 3:
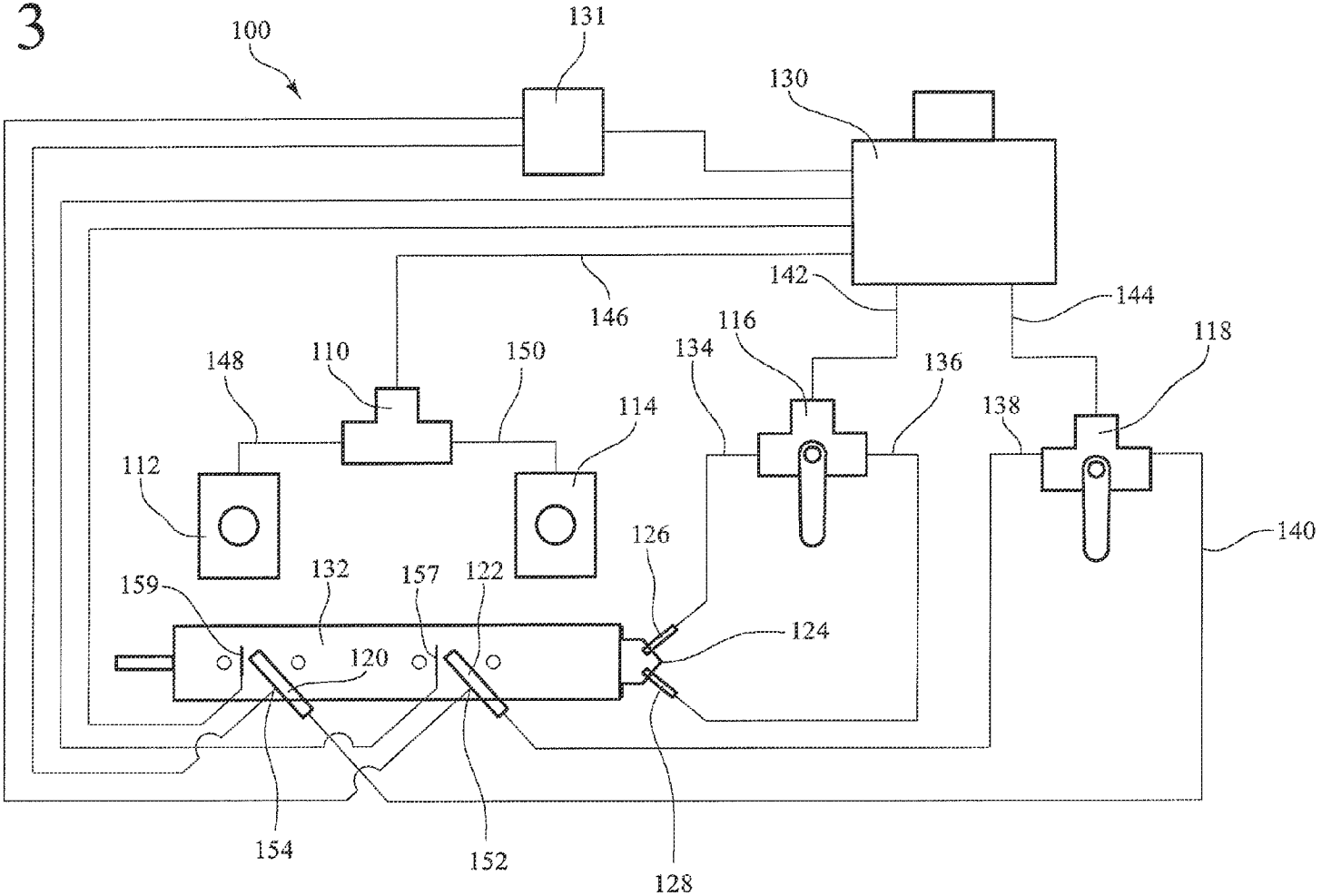
FIG. 3 is schematic view of the dual fuel vent free heater of FIG. 1 showing flow connection of component parts.

FIGS. 1, 2 and 3 show a dual fuel vent free heater 100. FIG. 1 shows the component parts of dual fuel vent free heater 100 in a housing 180 and FIG. 3 shows the flow diagram of heater 100. Dual fuel vent free gas heater 100 comprises a gas burner 132 having a plurality of gas outlet ports 155 (shown in FIG. 3) in an upper surface thereof. Gas outlet ports 155 are in flow communication with pilot flame burners 120 and 122. Brackets 139 hold pilot flame burners 120 and 122, piezometric igniters 157 and 159, and temperature sensors 152 and 154 proximate burner 132. Piezometric igniters 157 and 159 are in flow communication with pilot flame burners 122 and 120 respectively. Fuel injectors 126 and 128 are in flow communication with the interior portion of gas burner 132. Bracket 124 holds fuel injectors 126 and 128 at an injection angle with respect to a longitudinal axis of gas burner 132 other then 0.degree. Non-concentric alignment of injectors 126 and 128 with a burner venturi within burner 132 with hat bracket 124 controls angle of injectors which may be varied depending on the size of burner 132. Optionally, an oversized venturi may accommodate non-concentric injectors 126 and 128. Preferably, bracket 124 has threaded apertures for accommodation of injectors having a threaded outer annular surface. Therefore, any size burner 132 may used. Preferably, the injection angel of each injector is of the same magnitude. Fuel supply lines 134 and 136 are in flow communication with fuel injectors 126 and 128 respectively. Fuel supply line 134 and injector 126 have a composition and configuration for transporting a fuel such as natural gas or liquid propane at a desired flow rate and fuel supply line 136 and injector 128 have a composition and configuration for transporting a different fuel such as the other of natural gas or liquid propane at a desired flow rate.

FIG. 2 is a cutaway portion of dual fuel vent free heater 100 showing an oxygen detection system. The oxygen detection system has temperature sensors 152 and 154 in proximity to oxygen detection gas outlet ports 153 in gas burner 132. Oxygen detection gas outlet ports 153 extend down a cylindrical wall in gas burner 132 from the plurality of gas outlet ports 155 on the upper surface of burner 132. Oxygen detection control system 131, shown schematically in FIG. 3, is in electronic communication with temperature sensors 152 and 154 and thermostatic control 130 wherein thermostatic control 130 has valves controlling the flow of fuels to injectors 126 and 128 and pilot flame burners 120 and 122. Oxygen detection control system 131 sends an electronic signal to thermostatic control 130 directing thermostatic control 130 to close the valves shutting off the flow of fuel when a temperature sensor 157 or 159 indicates a temperature less than a control temperature.

Dual fuel vent free gas heater 100 comprises two regulators 112 and 114 in flow communication with "T" connector 110 via fuel lines 148 and 150 respectively. Fuel line 146 extends from "T" connector 110 to thermostatic control valve 130.

Pilot line 144 leads from thermostatic control valve 130 to pilot control valve 118. Injector line 142 leads from thermostatic control valve 130 to injector control valve 116. Fuel lines 138 and 140 lead from pilot control valve 118 to pilot flame burners 122 and 120 respectively. Fuel lines 136 and 134 lead from injector control valve 116 to injectors 126 and 128 respectively. Control valves 118 and 116 are manually adjusted for the fuel type being connected to regulator 112 or 114. Typically control valves 118 and 116 each have a setting for natural gas and a setting for liquid propane gas and are adjusted according to the fuel connected to regulator 112 or 114.

Figure 4:
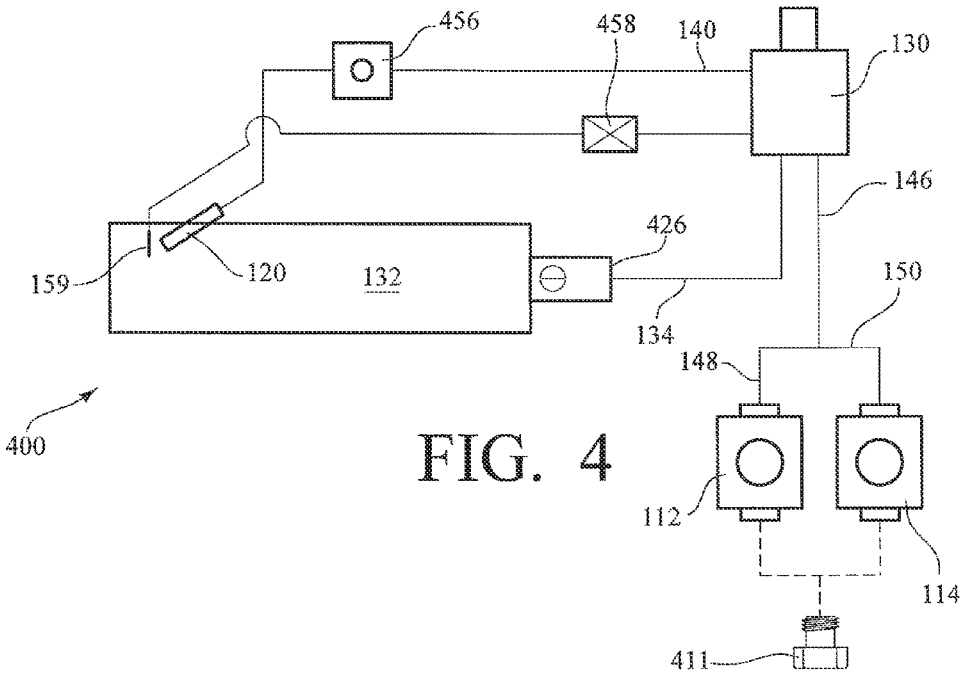
FIG. 4 is schematic view of a dual fuel vent free heater having a single multiuse injector and a thermal switch.

FIG. 4 shows a schematic view of dual fuel vent free heater 400 having a single burner 132 and a thermal switch 458. Gas burner 132 has a plurality of gas outlet ports in an upper surface thereof, fuel injector 426 is in flow communication with fuel supply line 134 and an interior of gas burner 132. Fuel injector 426 has a manual control valve therein for controlling the flow of a fuel to burner 132. Injector 426 has at least two settings for adjustment to alternate between at least two different fuels being fed from regulator 112 or regulator 114 through fuel supply line 134. Fuel supply line 134 is in flow communication with thermostat control 130. Fuel line 140 is in flow communication with thermostat control 130 and pilot burner 120 and has regulator 456 inline therewith. Regulators 114 and 112 each have back flow prevention systems or a plug 411 in allowing a single fuel tank to be connected to either regulator leaving the other regulator without a fuel source. Regulators 112 and 114 are each in flow communication with a "T" connector via fuel lines 148 and 150 respectively. Fuel inlet line 146 extends from the "T" connector and feeds into thermostat control valve 130. Thermal switch 458 is in electronic communication with thermostat control valve 130 and temperature sensor 159. Temperature sensor 159 is in proximity to pilot burner 120. Thermal switch 458 sends an electronic signal to thermostat control valve 130 shutting off fuel flow to fuel supply line 134 and pilot burner supply line 140 in the event that an incorrect setting is made with injector 426 with respect to the fuel being fed to regulator 112 or 114.

Figure 5:
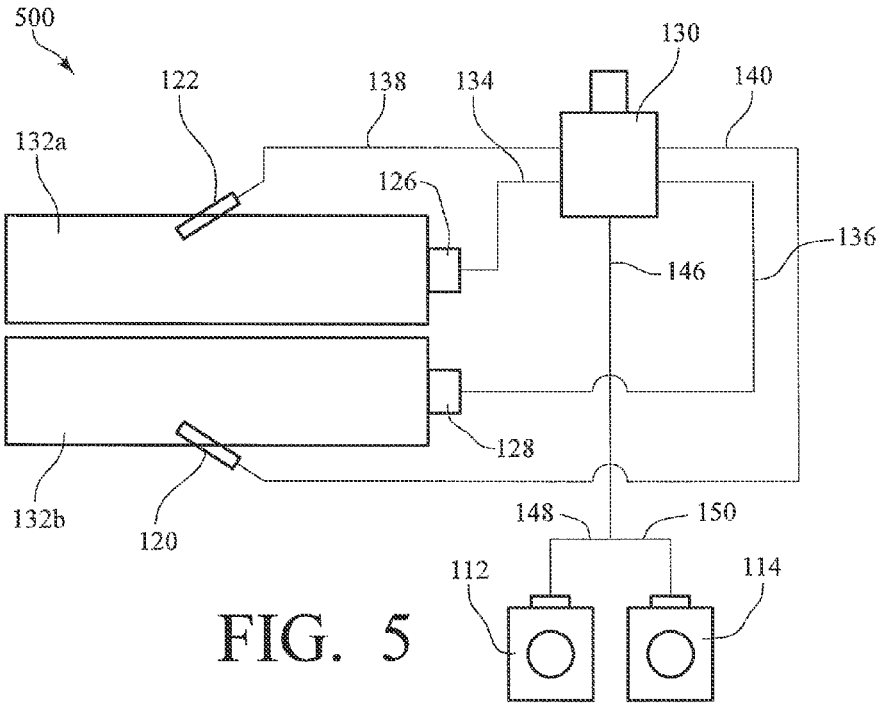
FIG. 5 is schematic view of a dual fuel vent free heater having a dual burner configuration.

FIG. 5 shows dual fuel vent free heater 500 having a dual burner configuration. Two regulators 112 and 114 are in flow communication with a "T" connector via fuel lines 148 and 150 respectively. Fuel line 146 extends from the "T" connector to thermostatic control valve 130. Pilot burner supply lines 138 and 140 lead from control valve 130 pilot flame burners 122 and 120 respectively. Fuel injector lines 134 and 136 lead from thermostatic control valve 130 to injectors 126 and 128 respectively. Burner 132*a* has first pilot flame burner 122 proximate gas outlet apertures therein and injector 126 proximate an axial opening. Burner 132*b* has pilot flame burner 120 proximate gas outlet apertures and injector 128 proximate an axial opening therein.

Figure 6:
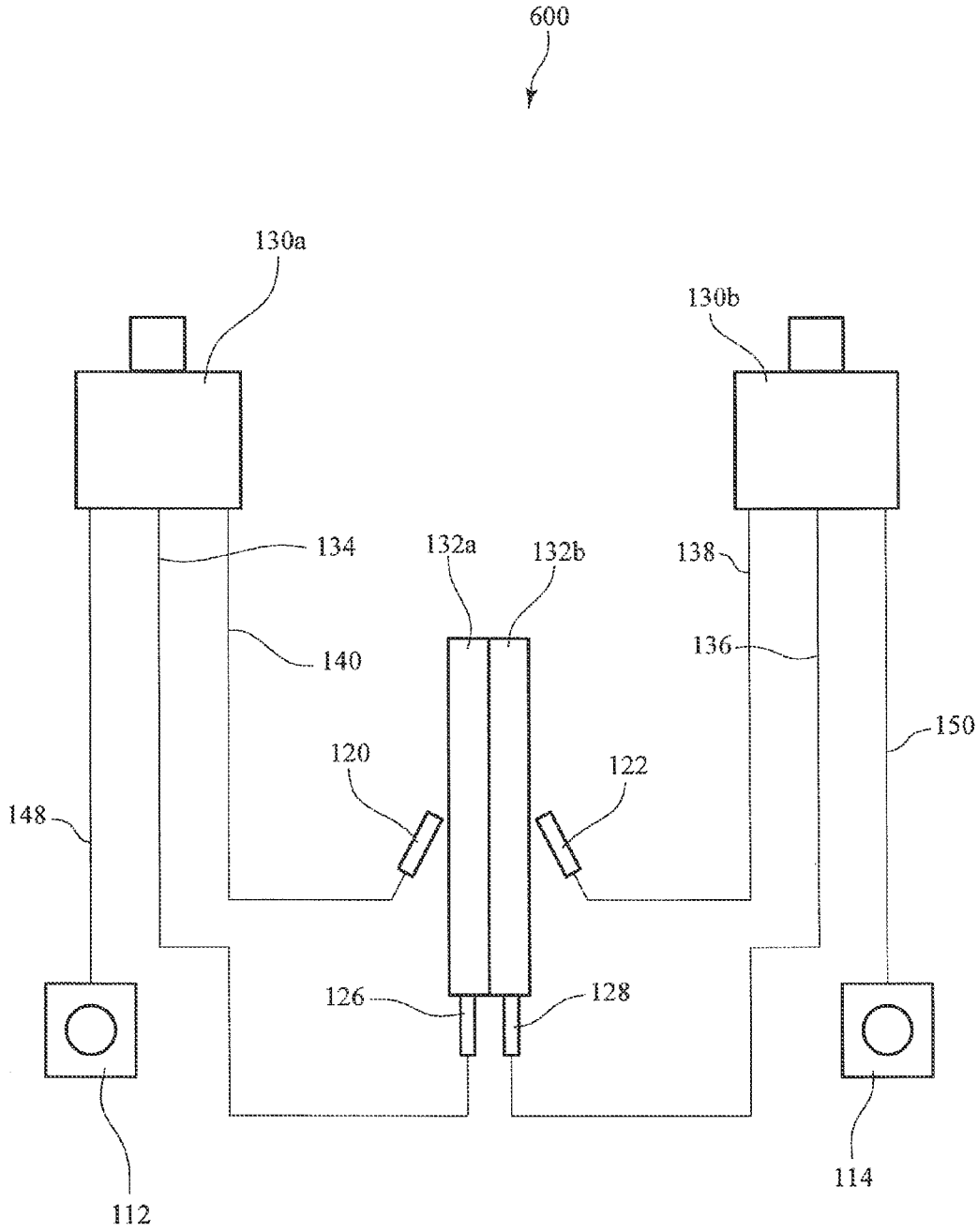
FIG. 6 is schematic view of a dual fuel vent free heater having a dual burner and dual thermostatic control valve configuration.

FIG. 6 is schematic view of dual fuel vent free heater 600 having a dual burner and dual thermostatic control valve configuration. Regulator 112 is in flow communication with control valve 130*a* via fuel line 148. Regulator 114 is in flow communication with control valve 130*b* via fuel line 150. Pilot supply line 140 leads from control valve 130*a* to pilot flame burner 120 and pilot supply line 138 leads from control valve 130*b* to pilot flame burner 122. Injector supply line 134 leads from control valve 130*a* to fuel injector 126. Injector supply line 136 leads from control valve 130*b* fuel injector 128. Burner 132*a* has pilot flame burner 120 proximate gas outlet apertures and fuel injector 126 proximate an axial opening. Burner 132*b* has pilot flame burner 122 proximate gas outlet apertures and fuel injector 128 proximate an axial opening therein.

Figure 7:
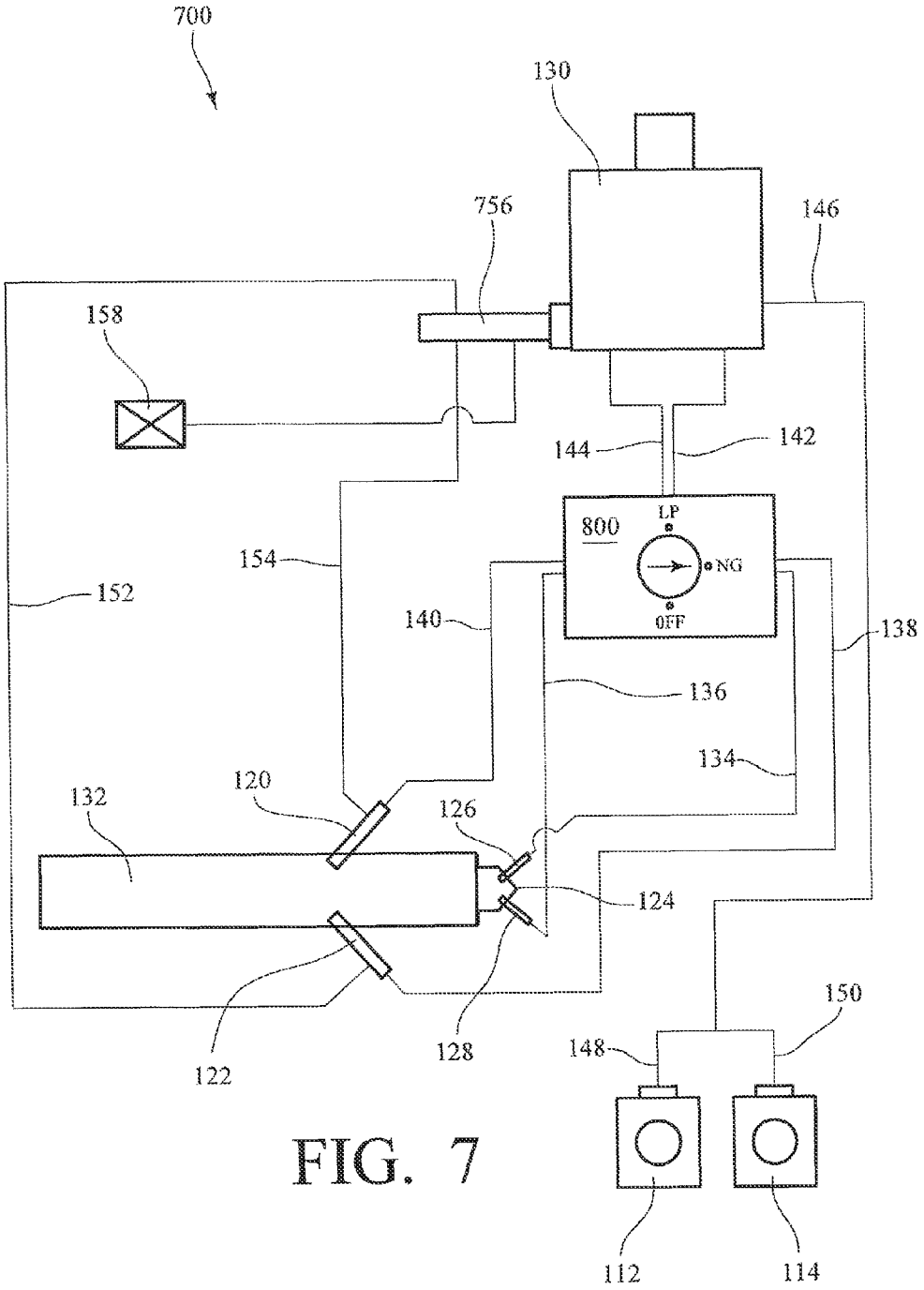
FIG. 7 is a schematic view of a dual fuel vent free heater having a multi-positional manual control valve, a thermal switch, and a thermostatic control valve.

FIG. 7 shows a schematic view of dual fuel vent free heater 700 having a multi-positional manual control valve 800. Regulators 112 and 114 are in flow communication with a "T" connector via fuel lines 148 and 150 respectively. Fuel line 146 extends from the "T" connector to thermostatic control valve 130. Pilot line 142 and injector line 144 lead from thermostatic control valve 130 to multi-positional manual control valve 800. Multi-positional manual control valve 800 directs flow from pilot line 142 and injector line 144 to pilot supply line 140 and injector supply line 136, or pilot supply line 138 and injector supply line 134, or blocks the flow from pilot line 142 and injector line 144. Burner 132 has injectors 126 and 128 held at an axial opening with bracket 124. Pilot burners 120 and 122 are proximate the outer surface of burner 132 and are in flow communication with pilot supply line 140 and 138 respectively. Thermal switch 158 is in electronic communication with T/C block 756. T/C block 756 is in electronic communication with a thermocouple proximate each pilot burner 120 and 122, via T/C lines 154 and 152, and control valve 130. In the event an incorrect setting is made with respect to the fuel being fed to the correct injector and pilot burner, thermal switch 158 or control valve 130 shuts off the flow of gas to heater 700.

Figure 8B:
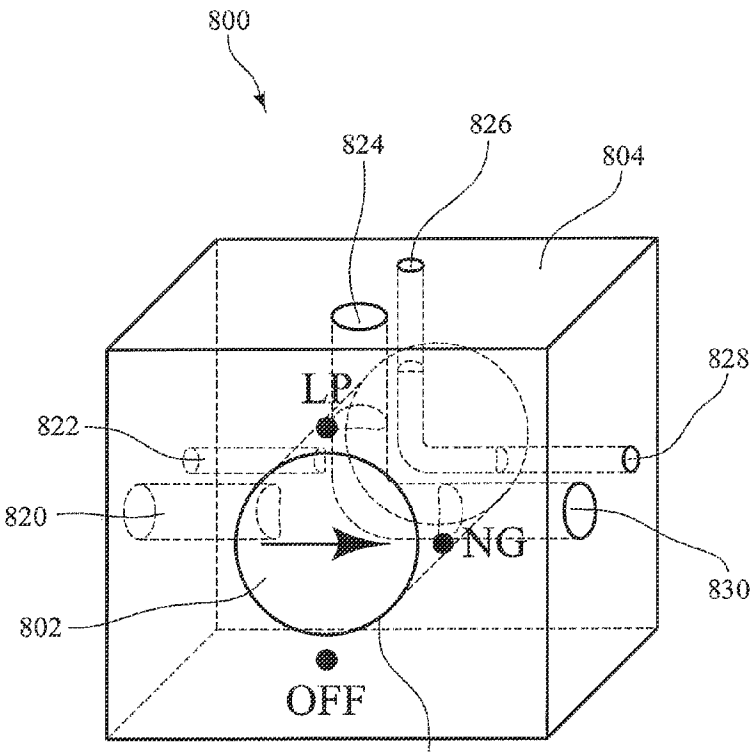
FIG. 8 is a blow-up view of the multi-positional manual control valve of FIG. 7.
Figure 8A:
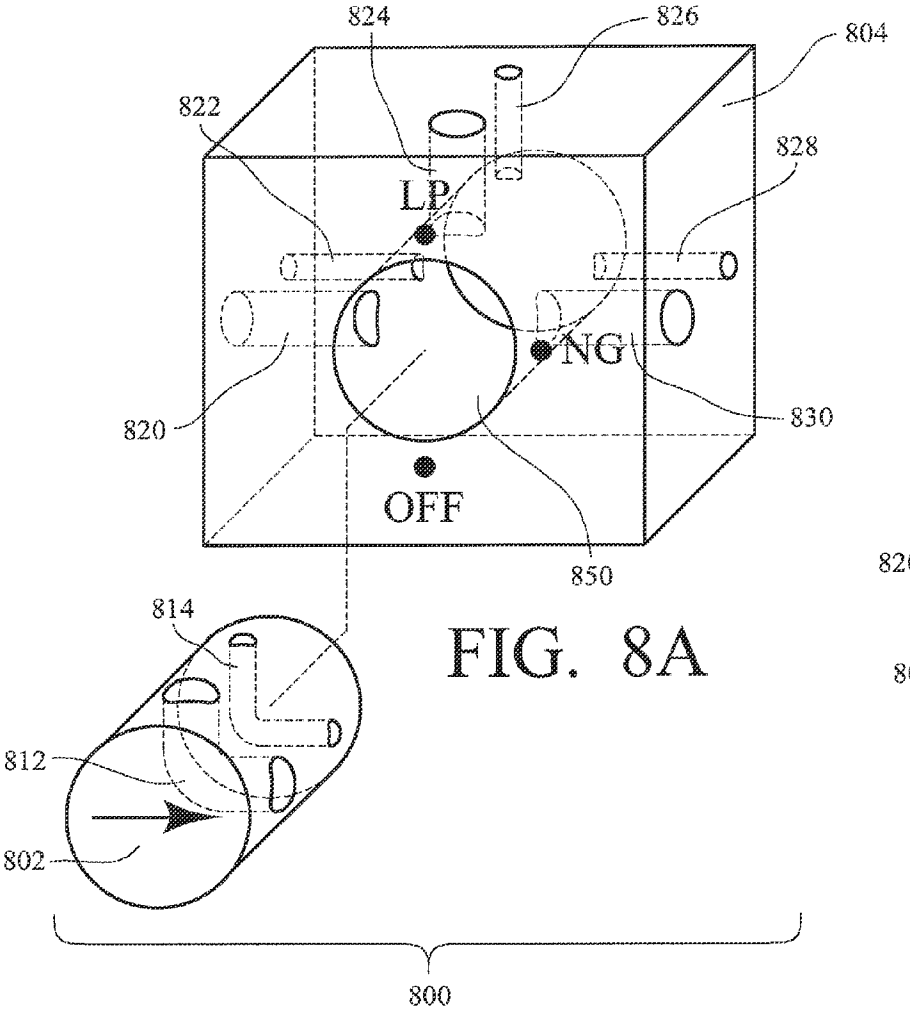

FIG. 8 shows a blow-up view of multi-positional manual control valve 800. Multi-positional manual control valve 800 comprises a control block 804 and a control cylinder 802. Control block 804 has a cylindrical aperture 850 extending from a front surface to a rear surface. The front surface of control 800 has fuel selection and cut off indicators LP, NG, and OFF. Three fuel injector apertures 820, 824 and 830 extend from cylindrical aperture 850 at about 90.degree. intervals to a left side, top, and right side of control block 804. A pilot aperture is axially aligned about cylindrical aperture 850 with each fuel injector aperture, pilot aperture 822 is axial aligned with injector aperture 820, pilot aperture 826 is axial aligned with injector aperture 824, and pilot aperture 828 is axial aligned with injector aperture 830. Control cylinder 802 has an outer circumference proximate the circumference of cylindrical aperture 850 in control block 804 wherein control cylinder 802 is closely received within. Control cylinder 802 has "L" shaped flow through fuel injector aperture 812 and an axially aligned "L" shaped flow through pilot aperture 814. Control cylinder 802 has a first, second, and third, position within the cylindrical aperture in control block 804. The front surface of control cylinder 802 has a selection arrow pointing to an appropriate indicator on the front surface of control block 804. At a first position, fuel injector aperture 820 and pilot aperture 822 are in flow communication with fuel injector aperture 824 and pilot aperture 826. At a second position, as shown in FIG. 8B, fuel injector aperture 824 and pilot aperture 826 are in flow communication with fuel injector aperture 830 and pilot aperture 828. At the third position, one end of the "L" shaped flow through fuel injector aperture 812 and axially aligned "L" shaped flow through pilot aperture 814 are blocked by the wall of cylindrical aperture 850 in control block 804 cutting off the flow of fuel.

Figure 9A:
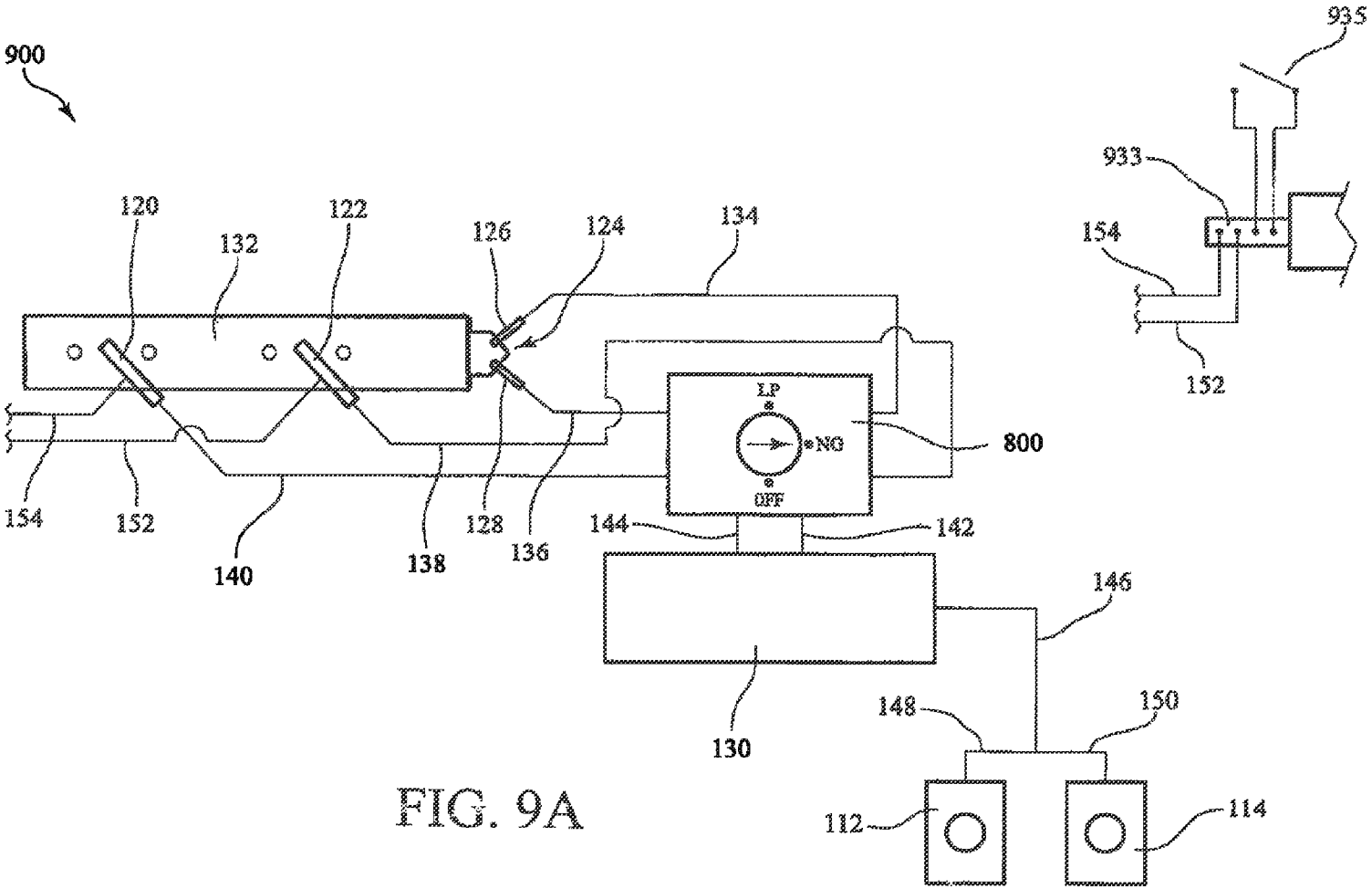
FIG. 9A is a schematic view of a dual fuel vent free heater having a multi-positional manual control valve, a thermal switch, a thermostatic control valve, and pilot burners.
Figure 9B:
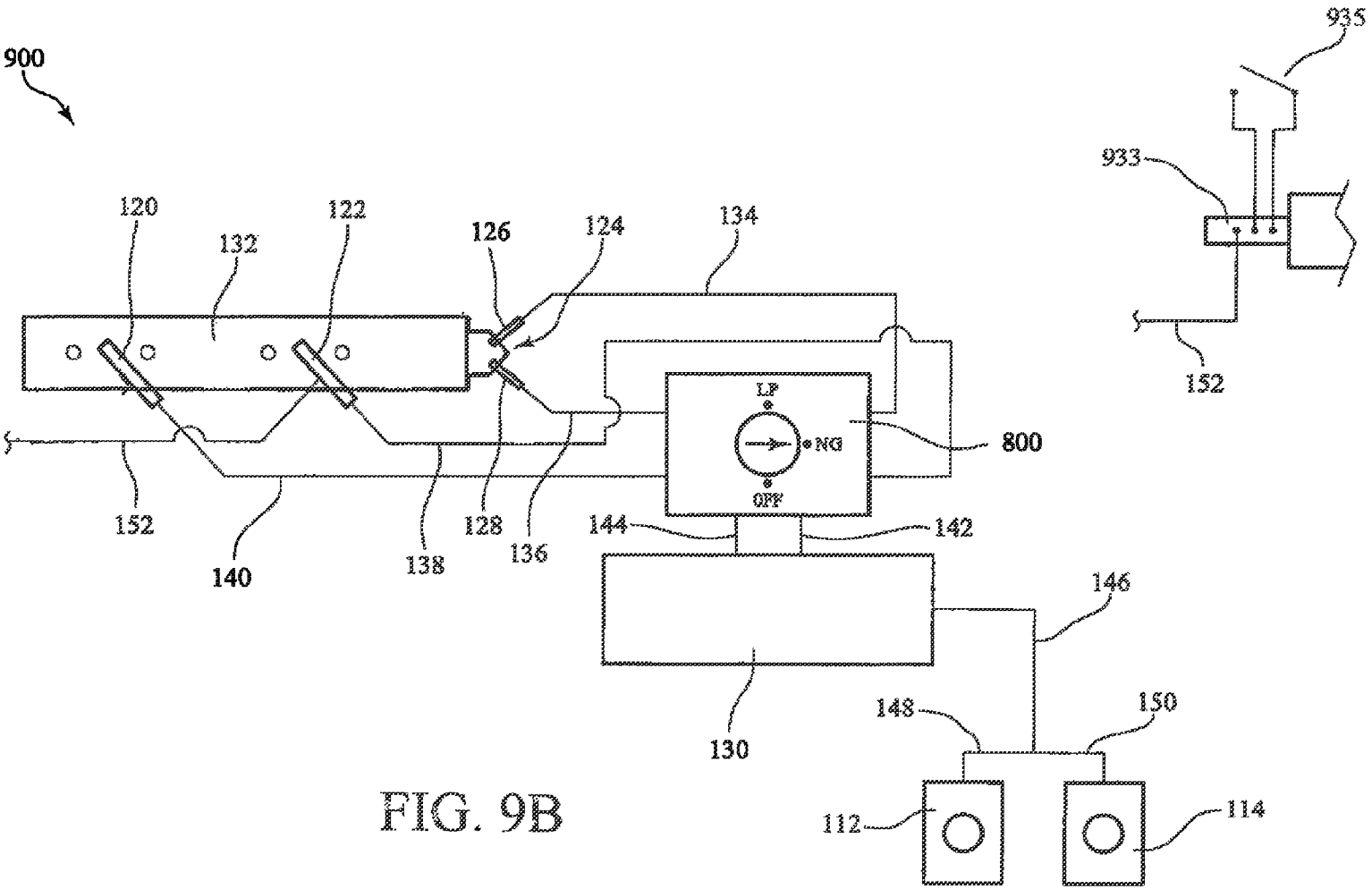
FIG. 9B is a schematic view of a dule fuel vent free heater having a multi-positional manual control valve, a thermal switch, a thermostatic control valve, and a pilot burners according to another implementation.

FIG. 9 shows a schematic view of dual fuel vent free heater 900. Dual fuel gas heater 900 comprises two regulators 112 and 114 in flow communication with a "T" connector via fuel lines 148 and 150. Fuel line 146 extends from the "T" connector to thermostatic control valve 130. A pilot line 142 and an injector line 144 lead from thermostatic control valve 130 to multi-positional manual control valve 800. Multi-positional manual control valve 800 has a first, second, and third control position as indicated with LP, NG, and OFF. The first control position creates a flow communication between the pilot line 144 and injector line 142 leading from thermostatic control valve 130 with pilot flame burner 120 and injector 128 through pilot feed line 140 and injector feed line 136 respectively. The second control position creates a flow communication between pilot line 144 and injector line 142 leading from thermostatic control valve 130 with pilot flame burner 122 and injector 126 respectively. The third position cuts off fuel flow from pilot line 144 and injector line 142 leading from thermostatic control valve 130. Thermal switch 935 is in electrical communication with a temperature sensor proximate pilot flame burners 120 and 122 via electrical connectors 154 and 152 respectively. Thermal switch 935 sends a shut off signal to a control valve when a first set temperature is exceeded in pilot flame burner 120 or a second set temperature is exceeded in pilot flame burner 122 cutting off the flow of fuel to heater 900.

In one implementation the thermal switch 935 is in electrical communication with the temperature sensor proximate pilot flame burner 122 and not with the temperature sensor proximate pilot flame burner 120. In one implementation, the thermal switch 935 is configured to transition from a closed state to an open state when a temperature at or near the pilot flame burner exceeds a predetermined temperature indicative that an LP gas is being supplied to the NG gas pilot flame burner. In one implementation, upon transitioning from the closed state to the open state, electrical power to a gas supply valve (e.g., thermostatic control valve 130) is interrupted resulting in the flow of fuel to heater 900 being terminated.

Figure 10:
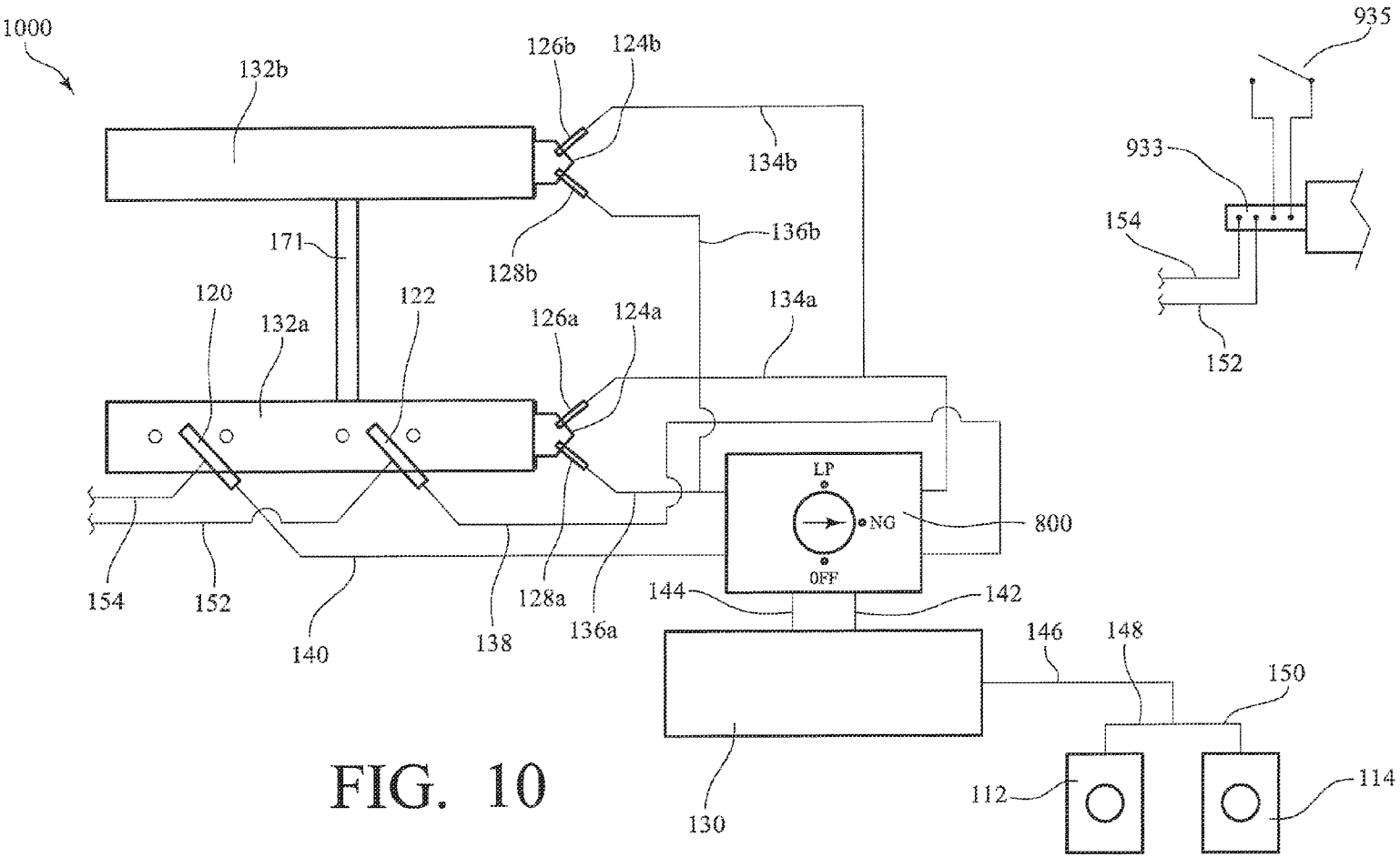
FIG. 10 is schematic view of the dual fuel vent free heater having a first burner, a second burner, and a cross-over burner for use in a vent free fireplace unit.

FIG. 10 shows a schematic view of dual fuel vent free heater 1000 having burner 132*a*, 132*b*, and cross-over burner 171. Such a configuration provides a blue flame burner and a yellow flame burner as is often desirable in a vent free fireplace heater. The configuration of heater 1000 is similar to the configuration of heater 900 with the addition of burners 132*b*, cross-over burner 171, two fuel line "T" connectors, and fuel injectors 126*b* and 128*b*. Crossover burner 171 is in flow communication with burners 132*a* and 132*b*. Burner 132*b* has fuel injectors 126*b* and 128*b* held by bracket 124*b* proximate an axial end and is situated substantially parallel burner 132*a*. Fuel supply line 134*b* feeds injector 126*b* with a "T" connector in flow communication with fuel supply line 134*a*. Fuel supply line 136*b* feeds injector 128*b* with a "T" connector in flow communication with fuel supply line 136*a*.

Figure 11:
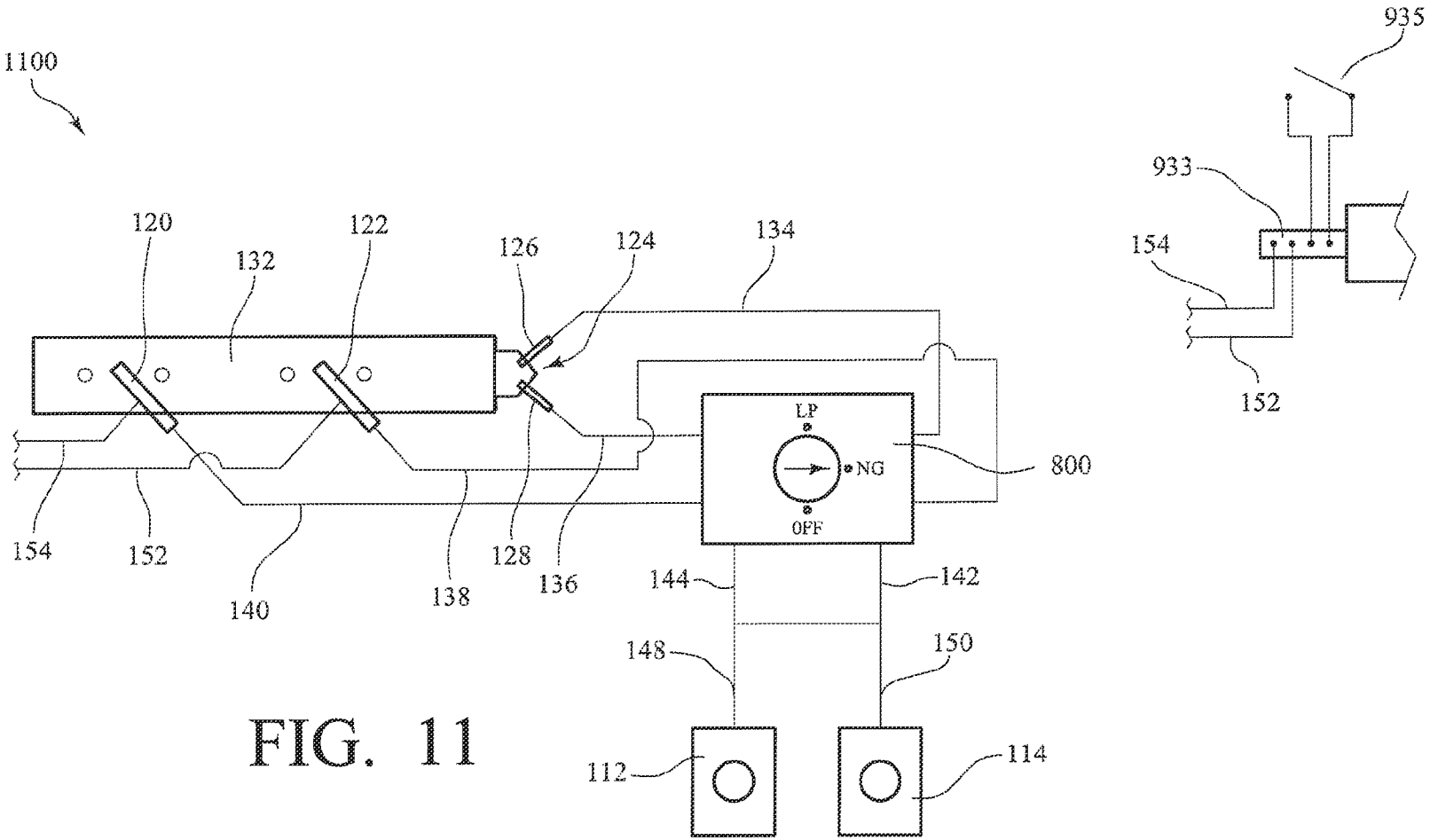
FIG. 11 is a schematic view of a dual fuel vent free heater having a multi-positional manual control valve directly controlling the flow of fuel into the heater.

FIG. 11 is a schematic view of dual fuel vent free heater 1100 having a multi-positional manual control valve 800 directly controlling the flow of fuel into heater 1100. The configuration of heater 1100 is similar to that of heater 900 but does not have thermostatic control 130. Rather, fuel from either regulator 112 or regulator 114 is fed through fuel line 148 or 150. Fuel lines 148 and 150 "T" into pilot line 142 and injector line 144 which lead directly to multi-positional manual control valve 800. Therefore, the amount of heat produced by heater 1100 is manually controlled with multi-positional manual control valve 800 without any thermostatic control.

What is claimed is:

1. A dual fuel vent free gas heater comprising:

a gas burner adapted to receive one of a first type of gas or of a second type of gas, a first pilot burner located adjacent the gas burner and intended to receive the first type of gas, a second pilot burner located adjacent the gas burner intended to receive the second type of gas, a normally closed control valve comprising an actuator and adapted to open upon a predetermined electrical voltage being applied to the actuator, the control valve situated to permit either the first type of gas or the second type of gas to flow through the control valve toward the gas burner when the control valve is in the open position, a first temperature sensor located adjacent the first pilot burner, a second temperature sensor located adjacent the second pilot burner, and a normally closed thermal switch coupled to the first temperature sensor and not to the second temperature sensor and located in an electrical flow path between a voltage source and the control valve actuator, the thermal switch configured to open when the temperature detected by the first temperature sensor exceeds a predetermined temperature indicative that the second type of gas is being delivered to the first pilot burner.

2. A dual fuel vent free gas heater according to claim 1, wherein the first type of gas is natural gas and the second type of gas is liquid propane gas.

3. A dual fuel vent free gas heater according to claim 1, wherein the first and second temperature sensors are thermocouples.

4. A dual fuel vent free gas heater according to claim 1, wherein the control valve is situated to permit either the first type of gas or the second type of gas to flow through the control valve toward the first and second pilot burners when the control valve is in the open position.

5. A dual fuel vent free gas heater comprising:

a gas burner adapted to receive one of a first type of gas or of a second type of gas, a first pilot burner located adjacent the gas burner and intended to receive the first type of gas, a second pilot burner located adjacent the gas burner and intended to receive the second type of gas, a normally closed control valve comprising an actuator and adapted to open upon a predetermined electrical voltage being applied to the actuator, the control valve situated to permit the first type of gas or the second type of gas to flow through the control valve toward the gas burner when the control valve is in the open position, a first temperature sensor located adjacent the first pilot burner and adapted to generate an electrical voltage deliverable to the control valve upon being heated by a pilot flame emitted by the first pilot burner, a second temperature sensor located adjacent the second pilot burner and adapted to generate an electrical voltage deliverable to the control valve upon being heated by a pilot flame emitted by the second pilot burner, and a normally closed thermal switch situated between the first temperature sensor and the control valve actuator and not situated between the second temperature sensor and the control valve actuator, the thermal switch configured to open when the temperature detected by the first temperature sensor is indicative that second type of gas is being delivered to the first pilot burner.

6. A dual fuel vent free gas heater according to claim 5, wherein the first type of gas is natural gas and the second type of gas is liquid propane gas.

7. A dual fuel vent free gas heater according to claim 5, wherein the first and second temperature sensors are thermocouples.

8. A dual fuel vent free gas heater according to claim 5, wherein the control valve is situated to permit either the first type of gas or the second type of gas to flow through the control valve toward the first and second pilot burners when the control valve is in the open position.

9. A dual fuel vent free gas heater comprising:

a gas burner adapted to receive one of a liquid propane gas or a natural gas, a first pilot burner located adjacent the gas burner and intended to receive the natural gas, a second pilot burner located adjacent the gas burner and intended to receive the liquid propane gas, a normally closed control valve comprising an actuator and adapted to open upon a predetermined electrical voltage being applied to the actuator, the control valve situated to permit either the natural gas or the liquid propane gas to pass through the control valve towards the gas burner, a first temperature sensor located adjacent the first pilot burner, a second temperature sensor located adjacent the second pilot burner, and a normally closed thermal switch coupled to the first temperature sensor and not coupled to the second temperature sensor, the thermal switch located in an electrical flow path between a voltage source and the control valve actuator, the thermal switch configured to open when the temperature detected by the first temperature sensor is indicative that liquid propane gas is being delivered to the first pilot burner.

10. A dual fuel vent free gas heater according to claim 9, wherein the first and second temperature sensors are thermocouples.

11. A dual fuel vent free gas heater according to claim 9, wherein the control valve is situated to permit either the natural gas or the liquid propane gas to flow through the control valve toward the first and second pilot burners when the control valve is in the open position.

12. A dual fuel vent free gas heater comprising:

a gas burner adapted to receive one of a liquid propane gas or a natural gas, a first pilot burner located adjacent the gas burner and intended to receive the natural gas, a second pilot burner located adjacent the gas burner and intended to receive the liquid propane gas, a normally closed control valve comprising an actuator and adapted to open upon a predetermined electrical voltage being applied to the actuator, the control valve situated to permit the natural gas or the liquid propane gas to flow through the control valve toward the gas burner when the control valve is in the open position, a first temperature sensor located adjacent the first pilot burner and adapted to generate an electrical voltage deliverable to the control valve upon being heated by a pilot flame emitted by the first pilot burner;

a second temperature sensor located adjacent the second pilot burner and adapted to generate an electrical voltage deliverable to the control valve upon being heated by a pilot flame emitted by the second pilot burner, and a normally closed thermal switch situated between the first temperature sensor and the control valve actuator and not located between the second temperature sensor and the control valve actuator, the thermal switch configured to open when the temperature detected by the first temperature sensor is indicative that liquid propane gas is being delivered to the first pilot burner.

13. A dual fuel vent free gas heater according to claim 12, wherein the first and second temperature sensors are thermocouples.

14. A dual fuel vent free gas heater according to claim 12, wherein the control valve is situated to permit either the natural gas or the liquid propane gas to flow through the control valve toward the first and second pilot burners when the control valve is in the open position.

* * * * *